US008066142B2

(12) United States Patent
Yin et al.

(10) Patent No.: US 8,066,142 B2
(45) Date of Patent: Nov. 29, 2011

(54) LOCKING BAR ANTI-THEFT DEVICE FOR CONTAINER

(75) Inventors: Jianhua Yin, Shanghai (CN); Hao Lin, Shanghai (CN)

(73) Assignee: Shanghai Haihang Spare Parts of Container Co., Ltd., Shanghai (CN)

( * ) Notice: Subject to any disclaimer, the term of this patent is extended or adjusted under 35 U.S.C. 154(b) by 353 days.

(21) Appl. No.: 12/448,325

(22) PCT Filed: Dec. 20, 2006

(86) PCT No.: PCT/CN2006/003493
§ 371 (c)(1),
(2), (4) Date: Jun. 17, 2009

(87) PCT Pub. No.: WO2008/074187
PCT Pub. Date: Jun. 26, 2008

(65) Prior Publication Data

US 2010/0038366 A1 Feb. 18, 2010

(51) Int. Cl.
*E05C 3/06* (2006.01)
*B65D 45/00* (2006.01)

(52) U.S. Cl. ..... 220/318; 292/DIG. 32; 292/DIG. 21; 292/259 A; 292/217; 70/466

(58) Field of Classification Search ..... 220/318; 292/217, 259 R, 307 R, 285, 104, 200, 202, 292/205, 218, 351, DIG. 21, DIG. 32; 70/27, 70/466, 77, 56
See application file for complete search history.

(56) References Cited

U.S. PATENT DOCUMENTS 2,297,007 A * 9/1942 Lounsbury ..... 292/241
(Continued)

FOREIGN PATENT DOCUMENTS

CN 2315245 4/1999
(Continued)

OTHER PUBLICATIONS

International Search Report for PCT/CN2006/003493, dated Oct. 11, 2007.

*Primary Examiner* — Anthony Stashick
*Assistant Examiner* — Kevin Castillo
(74) *Attorney, Agent, or Firm* — Wolf, Greenfield & Sacks, P.C.

(57) ABSTRACT

The present invention discloses a locking bar anti-theft device for container. It will still be effective in preventing the handle from disengaging from the handle hub even if the rivet is damaged; in addition, an internal structure is utilized so that the structure cannot be damaged, thus enhancing the safety of containers. Wherein a projection is provided on a plane by the side of the rivet hole at the front end of the handle corresponding to the sidewall of the handle hub; a guide groove is provided in the inner surface of the sidewall of the handle hub so as to guide the projection of the handle to enter the cavity of the handle hub; a rotary groove is provided in the inner surface of the sidewall of the handle hub so as to rotate the projection around the rivet after the handle is hinged to the handle hub; the guide groove communicates with the rotary groove; when the handle and the handle hub are hinged by the rivet, the projection is disengaged from the guide groove and enter the rotary groove; when the container is locked, the other end of the handle is fixed after driving the projection to rotate a certain angle inside the rotary groove.

8 Claims, 2 Drawing Sheets

U.S. PATENT DOCUMENTS

| | | | | |
|---|---|---|---|---|
| 5,553,904 | A * | 9/1996 | Lorenzo | 292/307 R |
| 6,412,834 | B1 * | 7/2002 | Waitai et al. | 292/197 |
| 7,441,425 | B2 * | 10/2008 | Jeong | 70/56 |
| 2008/0078222 | A1 * | 4/2008 | Jeong | 70/416 |

FOREIGN PATENT DOCUMENTS

| | | |
|---|---|---|
| CN | 2701797 | 5/2005 |
| CN | 2736306 | 10/2005 |
| CN | 2765878 | 3/2006 |
| GB | 1206689 | 9/1970 |
| GB | 1377939 | 12/1974 |
| GB | 2213134 | 8/1989 |
| JP | 10291587 | 11/1998 |
| JP | 2002-188346 | 7/2002 |

* cited by examiner

LOCKING BAR ANTI-THEFT DEVICE FOR CONTAINER

TECHNICAL FIELD

The present invention relates to a locking bar anti-theft device for container.

BACKGROUND ART

As shown in FIG. 1, it is a locking bar anti-theft device for the general container, comprising a locking bar 1; a handle hub 2; a rivet 3; a bush 4; a retainer catch 5; a retainer plate 6; a customs seal 7; and a handle 8. The handle hub 2 is fixed at the locking bar 1. Rivet holes are provided both at the front part of the handle 8 and on the U-shaped handle hub 2. The handle 8 is connected to the handle hub 2 by the rivet 3. When the container door is shut, the handle 8 is held in a slot of the retainer plate 6 and the retainer catch 5 is put down, and then customs functionaries will penetrate the customs seal 7 into the retainer catch 5 and the handle hole. The seal head is combined by the two. Because the handle 8 is connected to the handle hub 2 by the rivet 3, the handle can be disengaged easily from the handle hub if the rivet 3 is damaged, as shown in FIG. 2. Therefore, this disadvantage of the container is often used by lawbreakers to steal goods without damaging the customs seal.

The main principle of anti-theft handle developed under existing technology is as follows: a projection is provided near left side or left upper surface of the supporting slot of the retainer plate on the front of the handle position; the projection is used to prevent the handle from moving to the right in the slot of the retainer plate; thus when the rivet is damaged, the projection will still effectively prevent the handle from disengaging from the handle hub, and the container door cannot be opened.

However, the projection on the handle is exposed, once damaged, it will be impossible to effectively prevent the handle from being detached from the handle hub, the lawbreakers thus still have the possibility to chisel off the projection to commit a theft.

DISCLOSURE OF INVENTION

The technical problem that the present invention aims to solve is to provide a locking bar anti-theft device for container, which will still effectively prevent the handle from disengaging from the handle hub even if the rivet is damaged; and an internal structure is utilized so that the structure cannot be damaged, thus enhancing the safety of the container.

To solve the above technical problem, the present invention provides A anti-theft locking bar anti-theft device for container, installed on a door of the container, comprising a lock bar, a handle hub, a rivet, a handle, a retainer plate and a retainer catch; the handle hub consisting of U-shaped components or cloak-like components, on which a cavity is provided for the front end of the handle to be inserted; rivet holes are provided on the opposite sidewalls of the cavity; one of the opposite sidewalls is fixed on the lock bar of the door of the container; a rivet hole is provided on the front end of the handle to be hinged with the handle hub; when the container is locked, the front end of the handle is inserted into the cavity of the handle hub and is hinged to the handle hub by the rivet; and the other end of the handle is held between the retainer plate and the retainer catch; wherein a projection is provided on a plane by the side of the rivet hole at the front end of the handle corresponding to the sidewall of the handle hub; a guide groove is provided in the inner surface of the sidewall of the handle hub so as to guide the projection of the handle to enter the cavity of the handle hub; a rotary groove is provided in the inner surface of the sidewall of the handle hub so as to rotate the projection around the rivet after the handle is hinged to the handle hub; the guide groove communicates with the rotary groove; when the handle and the handle hub are hinged by the rivet, the projection is disengaged from the guide groove and enter the rotary groove; when the container is locked, the other end of the handle is fixed after driving the projection to rotate a certain angle inside the rotary groove.

According to the present invention, the anti-theft handle hub with the guide groove and the rotary groove and the anti-theft handle with the projection are used. Even if the rivet of the handle and the handle hub of container is chiseled off or damaged, the guide groove and rotary groove inside the handle hub as well as the projection of the handle cannot be damaged since they are well concealed. When the container is locked, the projection is disengaged from the guide groove and is located inside the rotary groove after rotating a certain angle, and it has to return from the guide groove if it needs to be extricated, which makes it impossible for the handle to be disengaged from the handle hub. Therefore the container cannot be opened, theft is avoided and the security of containerized cargo is guaranteed.

PREFERRED EMBODIMENT

Further description of the present invention will be given as follows combining figures and embodiments.

Figure 1:
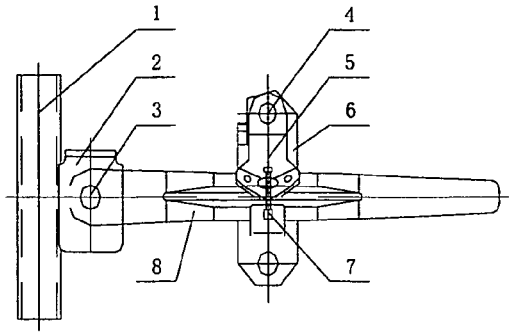
FIG. 1 is the assembly drawing of prior art before the rivet is removed.
Figure 2:
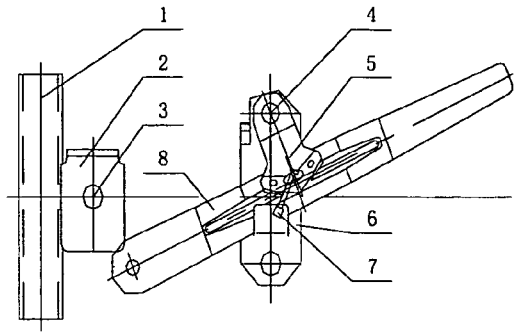
FIG. 2 is the assembly drawing of prior art after the rivet is removed.
Figure 3:
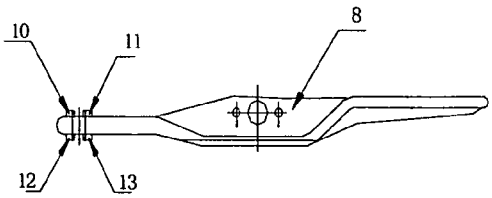
FIG. 3 is the front view of the handle structure of the present invention with projections on both sides.
Figure 4:
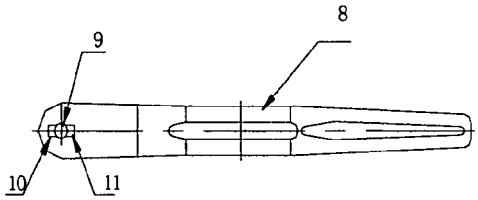
FIG. 4 is the bottom view of the handle structure of the present invention with projections on both sides.
Figure 5:
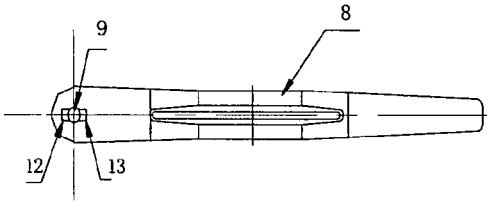
FIG. 5 is the top view of the handle structure of the present invention with projections on both sides.
Figure 6:
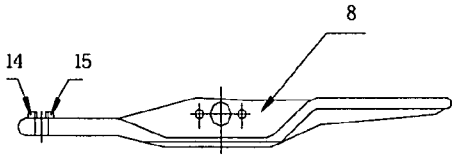
FIG. 6 is the front view of the handle structure of the present invention with projections on single side.
Figure 7:
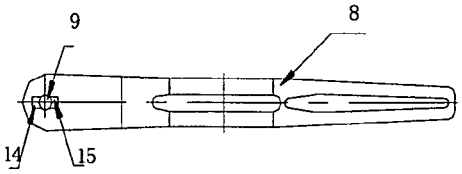
FIG. 7 is the bottom view of the handle structure of the present invention with projections on single side.

In FIG. 3 to FIG. 7, structure diagrams of the handle of the present invention are shown. As shown in FIG. 3-5, there are respectively the front view, the bottom view and the top view of the handle structure with projections on its both sides according to the present invention. It can be seen that four projections 10, 11, 12 and 13 are provided by the side of the rivet hole 9 on the top and bottom sides of the handle 8, which are positioned along the longitudinal central axis of the handle 8. As shown in FIG. 6 and FIG. 7, which are respectively the front view and the bottom view of the handle structure with projections on its single side according to the present invention, it can be seen that two projections 14 and 15 are provided by the side of the rivet hole 9 on the top side of the handle 8, which are located along the longitudinal central axis of the handle 8.

The number of projections provided on the handle 8 can be decided as it is needed. Generally, one projection will suffice, or more than two projections are provided. In addition, if needed, projections can be provided on either one surface or both surfaces of the handle 8.

Figure 8:
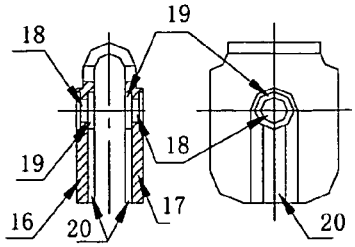
FIG. 8 is the structure drawing of the handle hub of the present invention with grooves in both sides.
Figure 8:
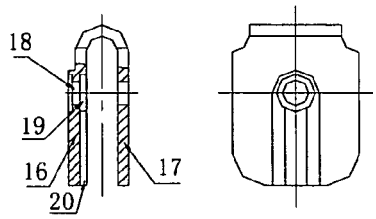
Figure 8:
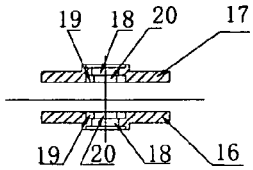
Figure 9:
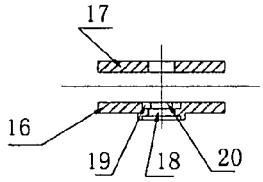
FIG. 9 is the structure drawing of the handle hub of the present invention with grooves in single side.

As shown in FIG. 8 and FIG. 9, these are structure drawings of the anti-theft handle hub according to the present invention. As shown in FIG. 8, it is the structure drawing of the handle hub with grooves in both sides according to the present invention, wherein FIG. 8.*a* is front view of handle hub with partial section, FIG. 8.*b* is left view of the handle hub, and FIG. 8.*c* is sectional view of the handle hub along the rivet hole. The guide groove 20 and the rotary groove 19 are provided in the inner surface of both sidewalls 16 and 17 of the handle hub 2, and the rotary groove 19 and the rivet hole 18 are positioned coaxially.

As shown in FIG. 9, it is the structure drawing of the handle hub with groove in single side according to the present invention, wherein FIG. 9.*a* is the front view of handle hub with partial section, FIG. 9.*b* is left view of the handle hub, and FIG. 9.*c* is the sectional view of the handle hub along the rivet hole. The guide groove 20 and the rotary groove 19 are positioned in the inner surface of the sidewall 16 of the handle hub 2, and the rotary groove 19 and the rivet hole 18 are poisoned coaxially; while no guide groove or rotary groove is provided in the inner surface of the sidewall 17.

Alternatively, the rotary groove 19 is not provided with wall on the side adjacent to the rivet hole of the handle hub. For example, as shown in FIG. 8 and FIG. 9, the rotary groove 19 and the rivet hole 18 are positioned coaxially so as to facilitate processing, and it will suffice to process only one counter bore. If needed, the rotary groove can be provided with two walls.

Figure 10:
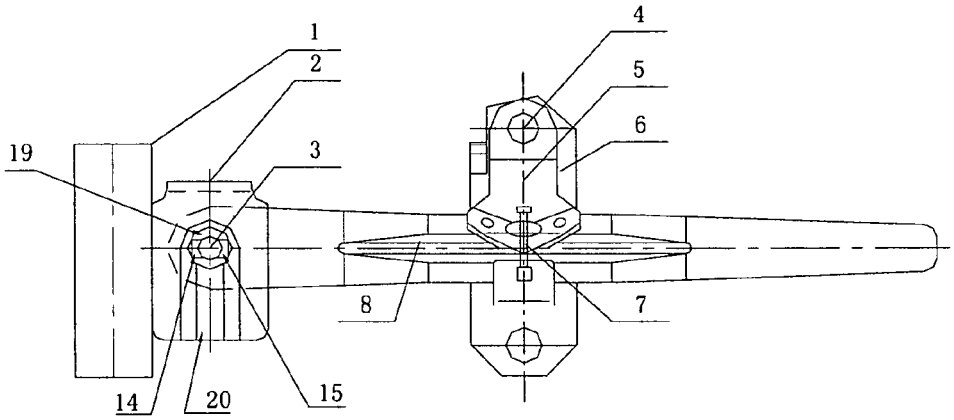
FIG. 10 is the structure drawing of the present invention in use.

As shown in FIG. 10, it is the structure drawing according to the present invention in use, which is the same as the installation status according to prior art. The handle hub 2 is fixed on the lock bar 1. Rivet holes are both provided at the front part of the handle 8 and in the U-shaped handle hub 2. The handle 8 is connected to the handle hub 2 by the rivet 3. When the container door is shut, the handle 8 is held in the slot of the retainer plate 6 and the retainer catch 5 is put down, and then customs functionaries will penetrate the customs seal 7 into the retainer catch 5 and the handle hole.

The differences between the present invention and the prior art are in that: when the handle 8 enters the handle hub 2, because of the projections 14 and 15 provided on the handle 8, it has to enter the cavity of the handle hub 2 from the guide groove 20 of the handle hub 2. When the container door is shut after the rivet 3 is installed, the projections 14 and 15 will rotate certain angle along the rotary groove 19 of the handle hub 2, and then the other end of the handle 8 is fixed within the retainer plate 6.

In FIG. 10, the position of the entry of the guide groove 20 is vertical down. Of course, the entry can also be provided in any position that makes it possible for the handle and the projections 14 and 15 to enter into the handle hub, such as below the horizontal position and above the vertical position.

In addition, because the projections 14 and 15 can only enter or exit from the guide groove 20, the projections 14 and 15 will be already located in the rotary groove 19 after the container is shut. If the rivet is damaged, the handle 8 will still be fixed inside the rotary groove of the handle hub 2 due to the function of the projections 14 and 15. If the handle 8 is to be removed, it has to be rotated certain angle to return into the guide groove 20 and then be removed along the guide groove 20, thus sufficient horizontal and vertical displacement will be required. However, such displacement is almost impossible, because the movement of the handle is restricted by the handle hub 2 and the retainer plate 6, unless by damaging the customs seal 7 on the retainer plate.

Figure 11:
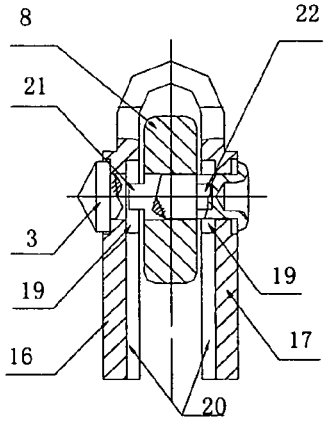
FIG. 11 is an assembly structure drawing of the handle with projections on its both sides and the handle hub according to the present invention.

As shown in FIG. 11, it is the assembly structure drawing of the handle with projections on its both sides and the handle hub according to the present invention. The handle 8 is hinged to the handle hub by the rivet 3, and the guide groove 20 and the rotary groove 19 are provided in the inner surface of the both sidewalls 16 and 17 of the handle hub. As can be seen from the section view, the projections 21 and 22 of the handle 8 are located in the guide groove 20 and the rotary groove 19 positioned the handle hub 2. Because the guide groove 20 and the rotary groove 19 are well concealed and cannot be damaged, the container door cannot be opened by lawbreakers and theft is avoided. Therefore, the present invention can fully guarantee the security of lock bar.

Figure 12:
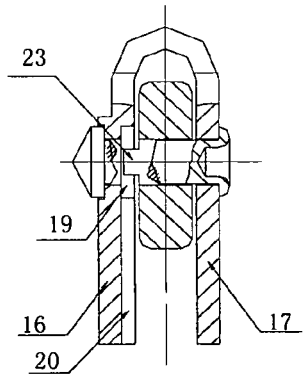
FIG. 12 is the assembly structure drawing of the handle with projections on its single side and the handle hub according to the present invention.

As shown in FIG. 12, it is the assembly structure drawing of the handle with projections on its single side and the handle hub according to the present invention. The guide groove 20 and the rotary groove 19 are provided in the inner surface of the sidewall 16 of the handle hub, and only one projection 23 is provided on the handle. No guide groove or rotary groove is provided in the sidewall 17. Although only one projection 23 is provided, the container door still cannot be opened by lawbreakers because the guide groove 20 and the rotary groove 19 are well concealed and cannot be damaged.

INDUSTRIAL APPLICABILITY

As an improvement over prior art, an anti-theft handle hub with a guide groove and a rotary groove and an anti-theft handle with a projection are adopted in the present invention. Even if the rivet of the handle and the handle hub of container is chiseled off or damaged, the guide groove and rotary groove inside the handle hub as well as the projection of the handle cannot be damaged since they are well concealed. When the container is locked, the projection is disengaged from the guide groove and is located inside the rotary groove after rotating a certain angle, and it has to return from the guide groove if it needs to be extricated, which makes it impossible for the handle to be disengaged from the handle hub. Therefore the container cannot be opened, theft is avoided and the security of containerized cargo is guaranteed.

The invention claimed is:

1. A locking bar anti-theft device for container, installed on a door of the container, comprising a lock bar, a handle hub, a rivet, a handle, a retainer plate and a retainer catch; the handle hub consisting of U-shaped components or cloak-like components, on which a cavity is provided for the front end of the handle to be inserted; rivet holes are provided on the opposite sidewalls of the cavity; one of the opposite sidewalls is fixed on the lock bar of the door of the container; a rivet hole is provided on the front end of the handle to be hinged with the handle hub; when the container is locked, the front end of the handle is inserted into the cavity of the handle hub and is hinged to the handle hub by the rivet; and the other end of the handle is held between the retainer plate and the retainer catch;

wherein a projection is provided on a plane by the side of the rivet hole at the front end of the handle corresponding to the sidewall of the handle hub;

a guide groove is provided in the inner surface of the sidewall of the handle hub so as to guide the projection of the handle to enter the cavity of the handle hub;

a rotary groove is provided in the inner surface of the sidewall of the handle hub so as to rotate the projection around the rivet after the handle is hinged to the handle hub;

the guide groove communicates with the rotary groove;

when the handle and the handle hub are hinged by the rivet, the projection is disengaged from the guide groove and enter the rotary groove; when the container is locked, the other end of the handle is fixed after driving the projection to rotate a certain angle inside the rotary groove.

2. The locking bar anti-theft device for container according to claim 1, wherein the projection is provided respectively on each plane by the side of the rivet hole at the front end of the handle corresponding to the opposite sidewalls of the handle hub, and the guide groove and the rotary groove are provided respectively in the inner surfaces of the sidewalls of the handle hub to engage with the projection.

3. The locking bar anti-theft device for container according to claim 1 or 2, wherein more than two projections are provided on planes by the side of the rivet hole at the front end of the handle corresponding to the sidewalls of the handle hub, and the guide grooves and the rotary groove are provided in the inner surfaces of the sidewalls of the handle hub to engage with the projections.

4. The locking bar anti-theft device for container according to claim 1 or 2, wherein the rotary groove is not provided with wall on the side adjacent to the rivet hole of the handle hub.

5. The locking bar anti-theft device for container according to claim 1 or 2, wherein entry of the guide groove is located in the inner surface of the sidewall of the handle hub under the horizontal position of the handle when the container is locked.

6. The locking bar anti-theft device for container according to claim 1 or 2, wherein the width of the guide groove is slightly greater than the width of the projection in the direction of entering the guide groove.

7. The locking bar anti-theft device for container according to claim 3, wherein the width of the guide groove is slightly greater than the width of the projection in the direction of entering the guide groove.

8. The locking bar anti-theft device for container according to claim 1, wherein the angle is greater than an angle in which the handle can rotate between the retainer plate and the retainer catch.

* * * * *